US009839095B2

(12) United States Patent
Qin et al.

(10) Patent No.: US 9,839,095 B2
(45) Date of Patent: Dec. 5, 2017

(54) PIXEL DRIVING CIRCUIT AND DISPLAY PANEL

(71) Applicant: EverDisplay Optronics (Shanghai) Limited, Shanghai (CN)

(72) Inventors: YongLiang Qin, Shanghai (CN); Jr Hong Chen, Shanghai (CN); Chu Wan Huang, Shanghai (CN)

(73) Assignee: EVERDISPLAY OPTRONICS (SHANGHAI) LIMITED, Shanghai (CN)

( * ) Notice: Subject to any disclaimer, the term of this patent is extended or adjusted under 35 U.S.C. 154(b) by 523 days.

(21) Appl. No.: 14/288,063

(22) Filed: May 27, 2014

(65) Prior Publication Data

US 2014/0354622 A1 Dec. 4, 2014

(30) Foreign Application Priority Data

May 31, 2013 (CN) ..... 2013 1 0217345

(51) Int. Cl.
*H05B 33/08* (2006.01)
*G09G 3/3233* (2016.01)

(52) U.S. Cl.
CPC ..... *H05B 33/0896* (2013.01); *G09G 3/3233* (2013.01); *G09G 2300/0819* (2013.01); *G09G 2300/0852* (2013.01); *G09G 2300/0861* (2013.01); *G09G 2310/0251* (2013.01); *G09G 2320/043* (2013.01)

(58) Field of Classification Search
CPC ..... G09G 3/3233; G09G 2300/0819; G09G 2300/0852; G09G 2300/0861; G09G 2310/00251; G09G 2320/0043; H05B 33/0896
See application file for complete search history.

(56) References Cited

U.S. PATENT DOCUMENTS 7,616,177 B2 11/2009 Peng et al.
2007/0040772 A1* 2/2007 Kim ..... G09G 3/3233 345/76
2012/0086694 A1* 4/2012 Tseng ..... G09G 3/3233 345/212

FOREIGN PATENT DOCUMENTS

CN 102682706 A 9/2012

* cited by examiner

*Primary Examiner* — Sahlu Okebato
(74) *Attorney, Agent, or Firm* — Andrew F. Young, Esq.; Lackenbach Siegel, LLP

(57) ABSTRACT

A pixel driving circuit includes a light-emitting working unit, a driving unit, a data signal input, a initial voltage input, a driving power input and a plurality of control level inputs. The driving unit includes a voltage storage element and a driving element. The driving element includes a first electrode, a second electrode and a control terminal. One end of the voltage storage element is connected to the control terminal of the driving element. The first electrode of the driving element forms a first input port of the input port of the driving unit. The pixel circuit is capable of improving the display effect and improving the display life of AM-OLED.

4 Claims, 4 Drawing Sheets

PIXEL DRIVING CIRCUIT AND DISPLAY PANEL

CROSS-REFERENCE TO RELATED APPLICATIONS

The present application claims priority to and the benefit of Chinese Patent Application No. CN 201310217345.8, filed on May 31, 2013, the entire content of which is incorporated herein by reference.

BACKGROUND OF THE INVENTION

Field of the Invention

The present disclosure relates to the technology of driving the display panel, more specifically, to a pixel driving circuit and a display panel.

Description of the Related Art

The traditional Active Matrix Organic Light Emitting Diode ("AM-OLED", hereinafter) is generally composed of a switch transistor, a driving transistor and a storage capacitor, i.e., the pixel driving mode of 2T1C is adopted thereof. When the scanning line is effective, the switch transistor is switched on, the input data signal is stored in the storage capacitor, and the storage capacitor controls to switch on the driving transistor by the stored voltage signal, thereby the input data voltage signal can be transformed into the required current signal for light-emitting OLED to display the different gray levels. FIG. 1 shows the 2T1C pixel circuit of LTPS (low temperature poly-silicon) AM-OLED in the related art.

Presently, the excimer laser anneal (ELA) is adopted in the process of LTPS, the threshold voltage ($V_{TH}$) of the transistor is not uniform in the space, thereby the threshold voltage ($V_{TH}$) of etch transistor has large difference. However, in the low gray level image, the nonuniformity of the LTPS AM-OLED with 2T1C structure in a small scope of the same direction will reach up to 30% to 40%, and the difference between the adjacent transistors also reach up to 20%. Moreover, when the pixel power line of the LTPS transistor is comparatively long, the power supply of the pixel circuit will generate a comparatively large IR drop, thereby the serious nonuniformity of the gray level generated in the display of AM-OLED. In the low gray level image, IR Drop of the 2T1C circuit with the same structure in 1.0V causes the nonuniformity of brightness reaching up to more than 70%. Due to the above mentioned cause, the problem that the long-range and the short-range of the AM-OLED display are not uniform, that is, the nonuniformity of the threshold voltage ($V_{TH}$) of transistor will not be compensated, and the influence of the nonuniformity to the AM-OLED display caused by power supply IR drop will not be eliminated.

A related art has disclosed a pixel circuit, comprising a light emitting diode, a driving transistor, a capacitor, and a switch unit. The driving transistor has a first source/drain coupled to one end of the light emitting diode. The capacitor is coupled between a gate of the driving transistor and the end of the light emitting diode. The switch unit couples the gate and a second source/drain of the driving transistor together, and couples the second source/drain of the driving transistor to a data line when a scan signal is asserted.

Another related art has disclosed a pixel driving circuit. A photo sensor is used in this driving circuit for sensing light from illumination devices to generate different induced currents. The different induced currents may form different driving currents to drive the illumination devices. Therefore, the illumination period of each illumination device is different but results in a same brightness after integration of each illumination device through a frame time.

Consequently, the related arts have not solved the problem that the nonuniformity of the threshold voltage ($V_{TH}$) of transistor can not be compensated and the influence to the nonuniformity of the AM-OLED display caused by power supply IR drop can not be eliminated.

SUMMARY OF THE INVENTION

An aspect of an embodiment of the present disclosure is directed toward a pixel driving circuit capable of compensating the problem that the threshold voltage $V_{TH}$ is nonuniform, eliminating the influence to AM-OLED caused by the power supply IR drop, to the maximum extent improving the display effect, and improving the display life of AM-OLED.

Another aspect of an embodiment of the present disclosure is directed toward for a pixel panel including the pixel driving circuit.

An embodiment of the present disclosure provides a pixel driving circuit for driving a light-emitting working unit, comprising:

a voltage storage element for storing a data voltage and a initial voltage, and also converting the data voltage and initial voltage into a compensation voltage;

a data input unit for controllably inputting the data voltage to the voltage storage element;

a initial voltage input for controllably inputting the initial voltage to the voltage storage element;

a driving power input for controllably supplying power to the light-emitting working unit;

a driving element for driving the light-emitting working unit;

wherein, the current supplied by the driving power input is controlled by the driving element which is responsive to magnitude of the compensation voltage discharged by the voltage storage element.

According to one embodiment of the present disclosure, wherein the driving element comprises a first electrode, a second electrode and a control terminal;

the first electrode is coupled to one end of the voltage storage element in parallel, which forms an input point;

the control terminal of the driving element is coupled to the other end of the voltage storage element in parallel, which forms an coupling point; and the second electrode is coupled to the coupling point in parallel, which forms an output point.

According to one embodiment of the present disclosure, wherein the data input unit comprises a data signal input and a first switch by which the data signal input is coupled to the input point.

According to one embodiment of the present disclosure, further comprising a second switch connected between the coupling point and the output point.

According to one embodiment of the present disclosure, further comprising a third switch by which the driving power input is connected to the input point.

According to one embodiment of the present disclosure, further comprising a fourth switch connected between the input point and the first electrode of the driving element.

According to one embodiment of the present disclosure, further comprising a fifth switch by which the initial voltage input is coupled to the input point.

According to one embodiment of the present disclosure, wherein the light-emitting working unit is coupled to the output point.

According to one embodiment of the present disclosure, wherein the light-emitting working unit comprises an OLED and a plate capacitor connected to the OLED in parallel.

According to one embodiment of the present disclosure, wherein the first switch comprises a control terminal; and the control terminal of the first switch is coupled to the control terminal of the driving element by a second plate capacitor.

According to one embodiment of the present disclosure, wherein the first switch, the second switch and the fifth switch are of P-type; and the first switch, the second switch and the fifth switch are controlled by a first level.

According to one embodiment of the present disclosure, wherein the third switch and the fourth switch are of P-type; and the third switch and the fourth switch are controlled by a second level.

Another embodiment of the present disclosure provides a display panel having a pixel driving circuit, comprising:

a voltage storage element for storing a data voltage and a initial voltage, and also converting the data voltage and initial voltage into a compensation voltage;

a data input unit for controllably inputting the data voltage to the voltage storage element;

a initial voltage input for controllably inputting the initial voltage to the voltage storage element;

a driving power input for controllably supplying power to the light-emitting working unit;

a driving element for driving the light-emitting working unit;

wherein, the current supplied by the driving power input is controlled by the driving element which is responsive to magnitude of the compensation voltage discharged by the voltage storage element.

According to another embodiment of the present disclosure, wherein the driving element comprises a first electrode, a second electrode and a control terminal;

the first electrode is coupled to one end of the voltage storage element in parallel, which forms an input point;

the control terminal of the driving element is coupled to the other end of the voltage storage element in parallel, which forms an coupling point; and the second electrode is coupled to the coupling point in parallel, which forms an output point;

wherein the data input unit comprises a data signal input and a first switch by which the data signal input is coupled to the input point.

According to another embodiment of the present disclosure, further comprising a second switch connected between the coupling point and the output point;

further comprising a third switch by which the driving power input is connected to the input point;

further comprising a fourth switch connected between the input point and the first electrode of the driving element; and further comprising a fifth switch by which the initial voltage input is coupled to the input point.

According to another embodiment of the present disclosure, wherein the light-emitting working unit is coupled to the output point; and the light-emitting working unit comprises an OLED and a plate capacitor connected to the OLED in parallel.

According to another embodiment of the present disclosure, wherein the first switch comprises a control terminal; and the control terminal of the first switch is coupled to the control terminal of the driving element by a second plate capacitor.

According to another embodiment of the present disclosure, wherein the first switch, the second switch, the third switch, the fourth switch and the fifth switch are of P-type;

the first switch, the second switch and the fifth switch are controlled by a first level; and the third switch and the fourth switch are controlled by a second level.

BRIEF DESCRIPTIONS OF THE DRAWINGS

The accompanying drawings, together with the specification, illustrate exemplary embodiments of the present disclosure, and, together with the description, serve to explain the principles of the present invention.

DETAILED DESCRIPTION

Figure 1:
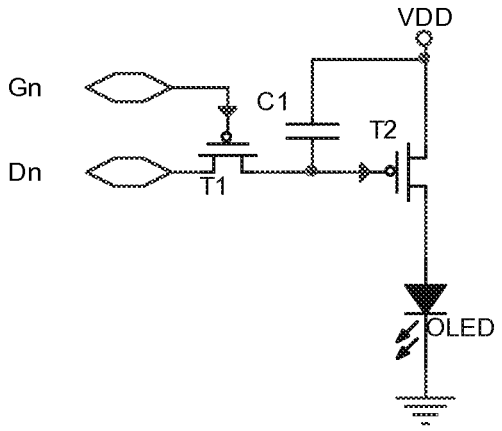
Figure 1 (Related Art)
FIG. 1 shows the structure schematic of a frequently-used pixel driving circuit of LTPS AM-OLED in the related art.

The present invention will now be described more fully hereinafter with reference to the accompanying drawings, in which exemplary embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like reference numerals refer to like elements throughout.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," or "includes" and/or "including" or "has" and/or "having" when used herein, specify the presence of stated features, regions, integers, steps, operations, elements, and/or components, but do not preclude the presence or addition of one or more other features, regions, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the term "plurality" means a number greater than one.

Hereinafter, certain exemplary embodiments according to the present disclosure will be described with reference to the accompanying drawings.

In an embodiment of the pixel driving circuit of the present disclosure, the circuit comprises a light-emitting working unit, a driving unit, a signal input, a reference level input, a driving power input and a plurality of control level inputs. The light-emitting working unit comprises an input port and a grounded output port. The driving unit comprises an input port, an output port and other primary units.

Figure 2:
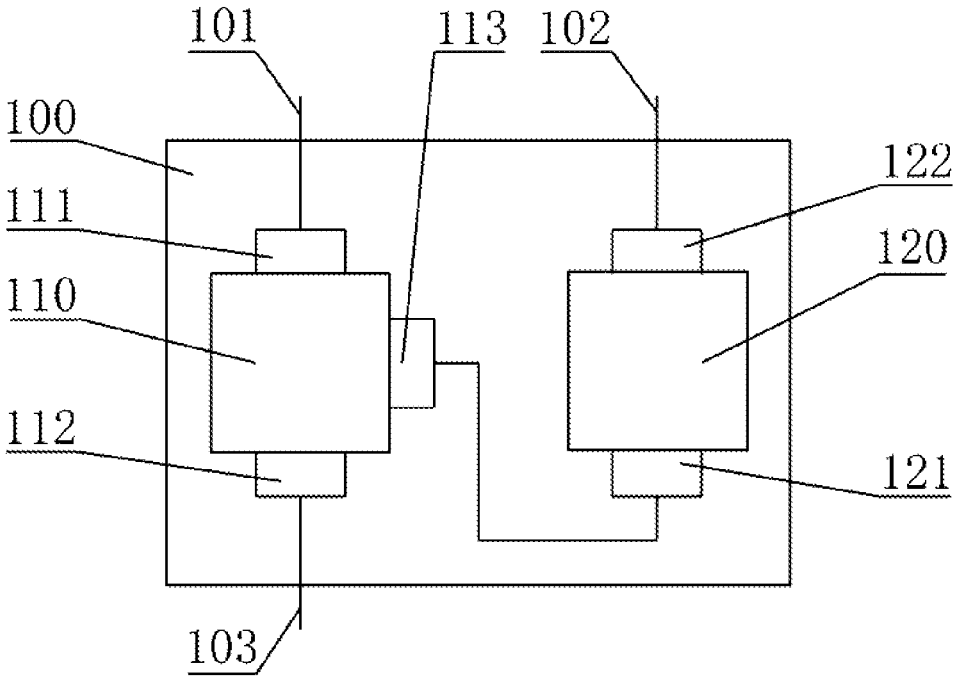
FIG. 2 shows the logical structure schematic of the driving unit of the pixel driving circuit in an embodiment of the present disclosure.

As shown in FIG. 2, Driving Unit 100 comprises a Voltage Storage Element 120 and a Driving Element 110; wherein, Driving Element 110 comprises a First Electrode 111, a Second Electrode 112 and a Control Terminal 113. The size of the current flowing through First Electrode 111 of Driving Element 110 and Second Electrode 112 of Driving Element 110 is controlled by Driving Element 110 according to the variation of the voltage loaded at Control Terminal 113. One End 121 of Voltage Storage Element 120 is connected to Control Terminal 113 of Driving Element 110. A First Input Port 101 of the input port of Driving Unit 100 is formed by First Electrode 111 of Driving Element 110. One End 122 of Voltage Storage Element 120, which is not connected to Control Terminal 113 of Driving Element 110, is formed as a Second Input Port 102 of the input port of Driving Unit 100, which is used for outputting current to the light-emitting working unit (not shown in Figures). In a preferred embodiment, Driving Element 110 can be formed by a driving transistor. Further, as the field of the technical solution in one embodiment according to the present disclosure is mainly about the pixel driving circuit of the display panel, the circuit can be realized by thin film transistors ("TFT", hereinafter). Specifically, the TFT can be a P-channel Metal Oxide Semiconductor ("PMOS", hereinafter) driving transistor. In another preferred embodiment, Voltage Storage Element 120 can be formed mainly by a non polar capacitor. Driving Unit 100 further comprises a compensation element (not shown in FIG. 2), which is coupled to Voltage Storage Element 120. The compensation element is connected to a first end of the voltage storage element and/or a second end of the voltage storage element. A closed circuit is formed by the compensation element, the voltage storage element and the driving element.

Figure 3:
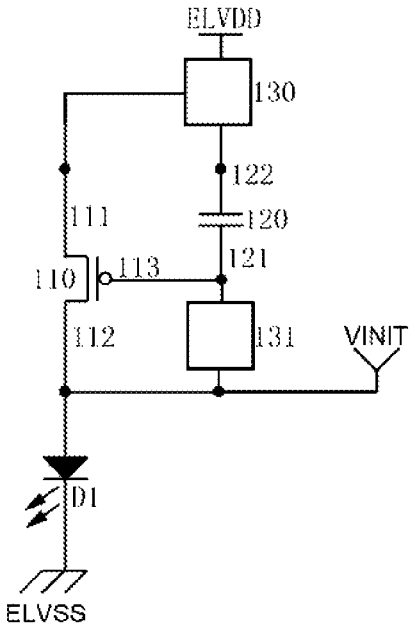
FIG. 3 shows the logical structure schematic of the driving unit of the pixel driving circuit in another embodiment of the present disclosure.

The compensation element comprises a switch block which is formed by switches whose on-off are controlled by the variation of a plurality of levels. As shown in FIG. 3, in an embodiment, the driving unit comprises Driving Element 110, Voltage Storage Element 120 and the compensation element; wherein, the compensation element comprises a First Compensation Element 130 and a Second Compensation Element 131. First Compensation Element 130 is connected to First Electrode 111 of Driving Element 110, End 122 of Voltage Storage Element 120 and the driving power input ELVDD respectively. Second Compensation Element 131 is connected to Control Terminal 113 of Driving Element 110, one End 121 of Voltage Storage Element 120, Second Electrode 112 of Driving Element 110 and the initial voltage input VINIT respectively. First Compensation Element 130 and Second Compensation Element 131 are provided with switches whose on-off is controlled by the variation of levels, which forms the switch block. A plurality of the switches is connected to a plurality of the control level inputs by a predetermined combination form. Furthermore, Driving Unit 100 can be switched between the data input compensation circuit structure and the display circuit structure according to the different combinations of on-off among a plurality of switches, thereby the data input compensation and the driving of the pixel circuit can be realized.

Figure 4:
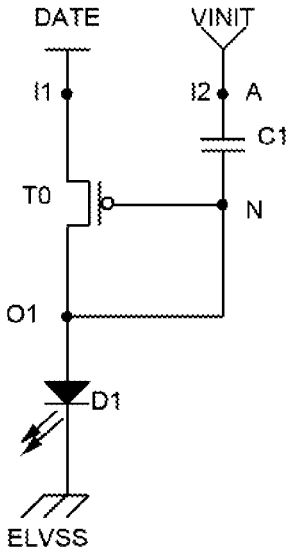
FIG. 4 shows the structure schematic of the driving unit of the pixel driving circuit in the data input compensation circuit structure in an embodiment of the present disclosure.

Firstly, the pixel driving circuit gets into the data input compensation stage to perform the data input compensation. Secondly, the pixel circuit gets into the display stage. Then the pixel driving circuit works in the two stages sequentially according to the circuit timing. FIG. 4 shows the schematic of the equivalent circuit, in which the driving unit of the pixel driving circuit is the input compensation circuit structure. What needs to be illustrated is that the devices provided in the figures are just for illustrating an embodiment according to the present disclosure, but it should not be deemed as limitation of the present disclosure. When the driving unit is the data input compensation circuit structure, the first input port I1 of the driving unit is connected to the data signal input DATA, and the second input port I2 of the driving unit is connected to the initial voltage input VINIT, and the output port O1 (an embodiment of output point) of the driving unit is connected to the input port of the light-emitting working unit and the control terminal of the driving transistor T0 which is used as the driving element respectively. The capacitor C1, which is used as the voltage storage element, is in charge of storing the voltage $V_{DATA}$ of the data signal input DATA and the threshold voltage $V_{TH}$ of the driving transistor T0. When the voltage $V_{DATA}$ of the data signal input DATA is loaded to Point N (an embodiment of coupling point), the voltage of Point N is changed to $V_{DATA}$-$V_{TH}$. The voltage $V_{INIT}$ of the initial voltage input VINIT is loaded on Point A (an embodiment of input point). Hence, the voltage of the capacitor C1 is that as follows:

$$V_{C1}=(V_{DATA}-V_{TH})-V_{INIT}.$$

Figure 5:
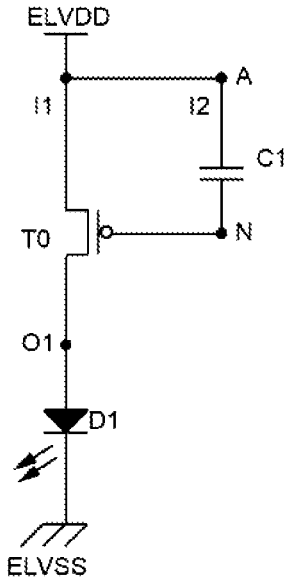
FIG. 5 shows the structure schematic of the driving unit of the pixel driving circuit in the display circuit structure in an embodiment of the present disclosure.

FIG. 5 shows the schematic of the equivalent circuit, in which the driving unit of the pixel driving circuit is the display circuit structure. What needs to be illustrated is that the devices provided in the figures is just for illustrating a embodiment according to the present disclosure, but it should not be deemed as limitation of the present disclosure. When the driving unit stays in the display circuit structure, the first input port I1 of the driving unit and the second input port I2 of the driving unit are connected to the driving power input ELVDD after being connected with etch other in parallel. The output port O1 of the driving unit is connected to the input port of the light-emitting working unit. The voltage of Point A is changed from $V_{INIT}$ of the data input compensation stage to $V_{ELVDD}$. As the voltage of the capacitor C1 used as the voltage storage element in the data input compensation stage is $V_{C1}$ which is acquired by the formula $V_{C1}=(V_{DATA}-V_{TH})-V_{INIT}$, the voltage of Point N is changed to $V_{ELVDD}$ which is acquired by the formula $V_{ELVDD}$+

$(V_{DATA}-V_{TH})-V_{INIT}$. As the computational formula of the current I flowing through the driving transistor T0 is that as follows:

$$I = \frac{1}{2}Cox\frac{\mu W}{L}(V_{GS} - V_{TH}),$$

the current ($I_{OLED}$) output by the input port O1 of the driving unit to the light-emitting working element is that as follows:

$$I_{OLED} = \frac{1}{2}Cox\frac{\mu W}{L}(V_{INIT} - V_{DATA})^2$$

wherein, Cox denotes the channel capacity of the unit area of the driving transistor (T0); μ denotes the channel mobility; W denotes the channel width; L denotes the channel length. It can be acquired from the above formula that the size of the current is controlled by $V_{INIT}$ and $V_{DATA}$. As the initial voltage input VINIT does not provide the driving current for emitting light in the light-emitting working unit, the voltage $V_{INIT}$ of the initial voltage input VINIT will not affected by IR DROP. Therefore, by using of the above mentioned technical solution, the nonuniformity of the threshold voltage of the driving transistor T0 can be compensated effectively, and when applied in the AM-OLED, the AM-OLED display nonuniformity caused by IR DROP can be eliminated.

In a preferred embodiment of the present disclosure, the light-emitting working unit could be an organic light-emitting element D1. Further, the light-emitting working unit also could be formed by an organic light-emitting element D1 and a capacitor. The anode of the organic light-emitting element D1 is connected to one end of the capacitor in parallel, which forms the input port of the light-emitting working unit. The working of the organic light-emitting element D1 can be stabilized by setting up the capacitor.

Figure 6:
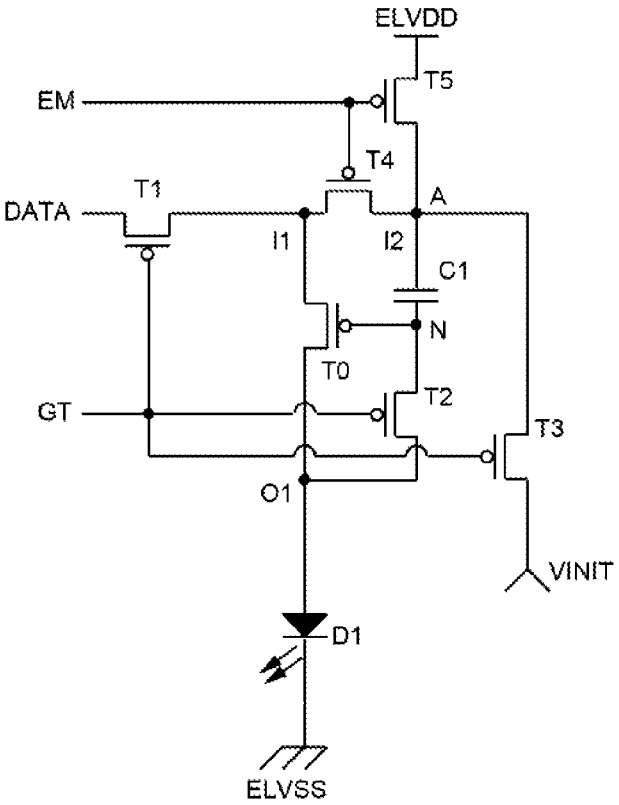
FIG. 6 shows the structure schematic of the driving unit of the pixel driving circuit in an embodiment of the present disclosure.

FIG. 6 shows the schematic of the circuit structure of the pixel driving circuit. What needs to be illustrated is that the devices provided in the figures are just for illustrating a technical solution of the present disclosure, but it should not be deemed as limitation of the present disclosure. The switch blocks in the circuit may comprise a first switch T1 which is connected between the data signal input DATA and the first input port I1 of the driving unit, and which controls on-off between the data signal input DATA and the first input port I1 of the driving unit; a second switch T2 which is connected between the output port O1 of the driving unit and the control terminal of the driving element T0, and which controls on-off between the output port O1 of the driving unit and the control terminal of the driving element T0; a third switch T3 which is connected between the second input port I2 of the driving unit and the initial voltage input VINIT, and which controls on-off between the second input port I2 of the driving unit and the initial voltage input VINIT. When the control levels input into the control terminal of the first switch T1, the control terminal of the second switch T2 and the third switch T3 are the same; the on-off states of the first switch T1, the second switch T2 and the third switch T3 are the same. The control terminal of the first switch T1, the control terminal of the second switch T2 and the control terminal of the third switch T3 can be connected to the same control level input of a plurality of control level inputs, that is the first switch T1, the second switch T2 and the third switch T3 will be switched on at the same time or switch off at the same time by the controls of the same control level input. As shown in FIG. 6, in a preferred embodiment of the present disclosure, three switch transistors are adopted to form the first switch T1, the second switch T2 and the third switch T3. As the field of the technical solution in the present disclosure is mainly about the pixel driving circuit of the display panel, the first switch T1, the second switch T2 and the third switch T3 can be realized by TFTs. Since there will be a large voltage difference at the both two ends of the third switch transistor T3, to consider the power dissipation controlling, the double gate structure can be adopted in the third switch transistor T3.

The switch block can further comprise: a fourth switch T4 which is connected between the first input port I1 of the driving unit and the second input port I2 of the driving unit, and which controls the on-off between the first input port I1 of the driving unit and the second input port I2; a fifth switch T5 which is connected between the driving power input ELVDD or the first input port I1 of the driving unit or connected between the driving power input ELVDD or the second input port I2. When the fourth switch is switched on, the first input port I1 of the driving unit is short connected to the second input port I2 of the driving unit. Therefore, no matter the driving power input ELVDD is connected to the first input port I1 of the driving unit or connected to the second input port I2 of the driving unit, the connection of the driving power input ELVDD and the driving unit in the display circuit structure can be realized.

When the control levels input into the control terminal of the fourth switch T4 and the control terminal of the fifth switch T5 are the same, the on-off states of the fourth switch T4 and the fifth switch T5 are the same. The control terminal of the fourth switch T4 and the fifth switch T5 can be connected to the same control level input of a plurality of control level inputs, that is the fourth switch T4 and the fifth switch T5 are switched on at the same time or switched off at the same time by the controls of the same control level input. As shown in FIG. 6, in a preferred embodiment of the present disclosure, two switch transistors are adopted to realize the fourth switch T4 and the fifth switch T5. As the field of the technical solution in the present disclosure is mainly about the pixel driving circuit of the display panel, the fourth switch T4 and the fifth switch T5 can be realized by TFTs. To use a first control level input GT and a second control level input EM as an example for illustrating, refer to FIG. 6, the first control level input GT (an embodiment of the first level) is connected to the control terminal of the first switch T1, the control terminal of the second switch T2 and the control terminal of the third switch T3; the second control level input EM is connected to the control terminal of the fourth switch T4 and the control terminal of the fifth switch T5.

When the first control level input GT provides a level signal to switch on the first switch T1, the second switch T2 and the third switch T3, and the second control level input EM (an embodiment of the second level) provides a level signal to switch off the fourth switch T4 and the fifth switch T5, the circuit structure provided in FIG. 6 is changed to the data input compensation circuit structure as shown in FIG. 2. Likewise, when the first control level input GT provides a level signal to switch off the first switch T1, the second switch T2 and the third switch T3, and the second control level input EM provides a level signal to switch on the fourth switch T4 and the fifth switch T5, the circuit structure provided in FIG. 6 is changed to the display circuit structure as shown in FIG. 4.

Figure 7:
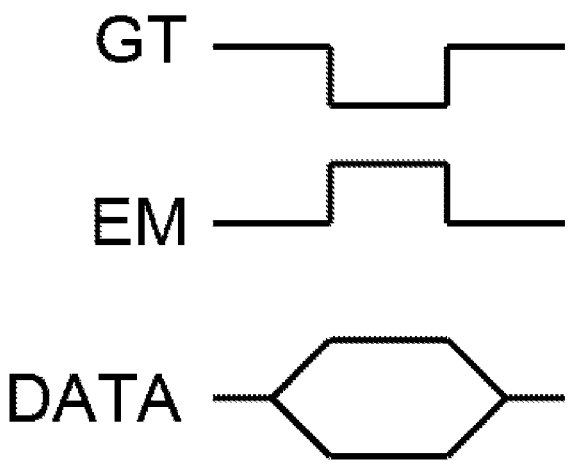
FIG. 7 shows the driving timing of the circuit schematic in FIG. 6.

It can be acquired by the above mentioned example, when the on-off characteristics of the first switch T1, the second switch T2, the third switch T3, the fourth switch T4 and the fifth switch T5 are all the same, in another word, the control levels input into the control terminal of the first switch T1, the control terminal of the second switch T2, the control terminal of the third switch T3, the control terminal of the fourth switch T4 and the control terminal of the fifth switch T5 are the same, the on-off states of the first switch T1, the second switch T2, the third switch T3, the fourth switch T4 and the fifth switch T5 are the same. It can be controlled by a couple of control level inputs which are mutually inverse signals. That is, the first control level input GT and the second control level input EM are mutually inverse signals. When the first switch T1, the second switch T2 and the third switch T3 are switched on by the first control level input GT, the fourth switch T4 and the fifth switch T5 are switched off by the second control level input EM which is opposite to the first control level input GT. Likewise, when the first switch T1, the second switch T2 and the third switch T3 are switched off by the first control level input GT, the fourth switch T4 and the fifth switch T5 are switched on by the second control level input EM which is opposite to the first control level input GT. The sequential control chart provided in FIG. 7 is a control scheme of adopting the above mentioned embodiments.

Further, when the on-off characteristics of the first switch T1, the second switch T2, the third switch T3, the fourth switch T4 and the fifth switch T5 are opposite, that is when the control levels input into the control terminal of the first switch T1, the control terminal of the second switch T2, the control terminal of the third switch T3, the control terminal of the fourth switch T4 and the control terminal of the fifth switch T5 are the same, the on-off states of the first switch T1, the second switch T2 and the third switch T3 are all opposite to that of the fourth switch T4 and the fifth switch T5. In this case, when the first switch T1, the second switch T2 and the third switch T3 are switched on just by a control level input, the fourth switch T4 and the fifth switch T5 are switched off. Likewise, when the first switch T1, the second switch T2 and the third switch T3 are switch off, the fourth switch T4 and the fifth switch T5 are switched off. Since this embodiment can reduce a control level input, the layout can be simplified.

Meanwhile, when the on-off characteristics of the first switch T1, the second switch T2, the third switch T3, the fourth switch T4 and the fifth switch T5 are the same, the first switch T1, the second switch T2 and the third switch T3 are switched on by a control level input, and the fourth switch T4 and the fifth switch T5 are switched off by the control level input; when the first switch T1, the second switch T2 and the third switch T3 are switched off by the control level input, the fourth switch T4 and the fifth switch T5 are switch on. That is the control level input is connected to the control terminal of the first switch T1, the control terminal of the second switch T2 and the control terminal of the third switch T3, and connected to the control terminal of the fourth switch T4 and the control terminal of the fifth switch T5 by the level reversing device; or the control level input is connected to the control terminal of the fourth switch T4 and the control terminal of the fifth switch T5, and connected to the control terminal of the first switch T1, the control terminal of the second switch T2 and the control terminal of the third switch T3 by the level reversing device. Wherein, the quantity of the level reversing device can be set as one, and also can be set as above one according to the number of the switches need to be connected. In a preferred embodiment, the level reversing device is realized by the NOR gate device.

In the ideal capacitor charging circuit, the time of the voltage at the two ends of the capacitor reaching 63.2% of the target voltage is a constant τ, τ=R*C. The charging voltage is $V_c=V(1-e^{-t/\tau/})$. Hence, it needs more time to reach the target voltage V. As shown in the following table:

| Time | τ | 2τ | 3τ | 4τ | 5τ |
|---|---|---|---|---|---|
| Vc/V | 63.2% | 86.5% | 95% | 98.2% | 99% |

Thus it can be seen that it needs a period of time for the capacitor reaching the target charging voltage, which will affect the display. In view of the problem that it takes a long period of time for the capacitor to charge the target voltage, in the embodiment of the present disclosure, the speed of charging can be increased by a way of adding a capacitor.

Figure 8:
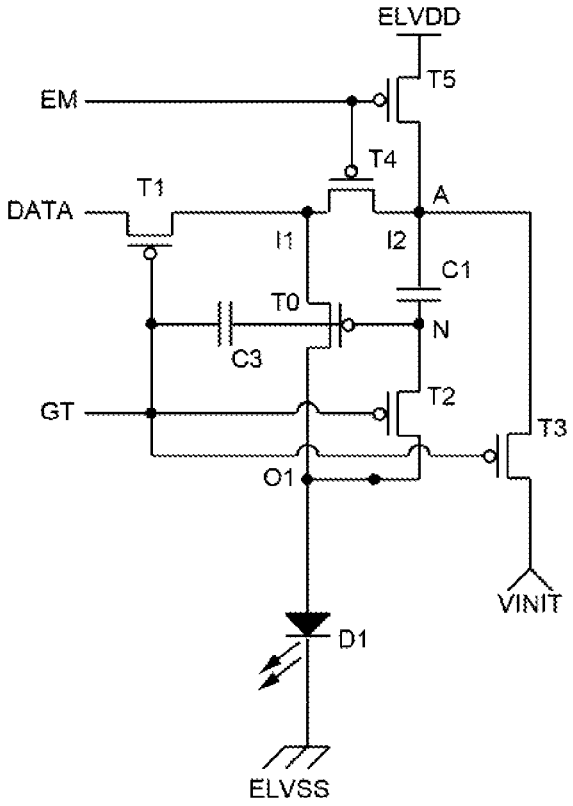
FIG. 8 shows the structure schematic of the pixel driving circuit in another embodiment of the present disclosure.

As shown in FIG. 8, the control terminal of the driving transistor T0 which is used as the driving element is connected to the control terminal of the first switch T1 or the control terminal of the second switch T2 or the control terminal of the third switch T3 by a capacitor C3.

By ways of adding a capacitor C3 between the control terminal of the driving transistor T0 and the control terminal of the first switch T1 can improve the charging speed of the display data voltage by utilizing the signal of the first control level input GT. At this moment, the current $I_{OLED}$ which is input into the light-emitting working unit by the output port of the driving unit in the light-emitting stage is changed to that as follows:

$$I_{OLED} = \frac{1}{2}Cox\frac{\mu W}{L}\left(V_{INIT} - V_{DATA} + \Delta V_{GT}\left(\frac{C_{C3}}{C_{C3} + C_{C1}}\right)\right)^2$$

It can be seen from the above formula, $I_{OLED}$ is not affected by $V_{ELVDD}$ or $V_{TH}$. Thus the adverse effect to OLED display, which is caused by $V_{TH}$ and the power line IR Drop, also can be eliminated. And the charging speed of the display data voltage is improved.

The embodiment of the present disclosure further comprises a display panel, wherein, the above mentioned pixel driving circuit is adopted in it.

The embodiment of the present disclosure provides a new compensation circuit of the 6T1C and the timing sequence for driving the circuit, which can compensate the influence of the OLED display caused by the nonuniformity of the spatial distribution of the channel mobility (μ) and the threshold voltage ($V_{TH}$) of the LTPS transistor, and can compensate the influence of the OLED display caused by IR drop generated by the power line of the pixel circuit. The nonuniformity of the OLED display of the 2T1C pixel driving circuit in the AM-OLED of the related art is improved, so that the influence of $I_{OLED}$ caused by $V_{TH}$ and the power line IR Drop is significantly reduced. The reduction can reach up to about 1.6% to 3%.

Hence, the technical solution of the pixel circuit structure adopted significantly solves the problem that the threshold voltage $V_{TH}$ in the pixel driving circuit in the related art is not uniform and that the uniformity of the AM-OLED display is influenced by the existing voltage drop IR drop, thereby the display effect of AM-OLED is to a maximum extent improved. Therefore, the technical solution of the pixel circuit structure adopted has broad prospects. Moreover, the pixel driving circuit can select an appropriate voltage $V_{INIT}$ of the reference level VINIT. Thus, in the data input compensation stage, the reverse bias of the OLED device is generated by the data input, and the OLED is reverse annealed, thereby the display life of AM-OLED is improved.

While the present disclosure has been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. A pixel driving circuit for driving a light-emitting working unit, comprising:

a voltage storage element for storing a data voltage and an initial voltage, and also converting the data voltage and initial voltage into a compensation voltage;

a data input unit for controllably inputting the data voltage to the voltage storage element;

an initial voltage input for controllably inputting the initial voltage to the voltage storage element;

a driving power input for controllably supplying power to the light-emitting working unit;

a driving element for driving the light-emitting working unit;

wherein, the current supplied by the driving power input is controlled by the driving element which is responsive to magnitude of the compensation voltage discharged by the voltage storage element;

the driving element comprises a first electrode, a second electrode and a control terminal;

the first electrode is coupled to one end of the voltage storage element in parallel, which forms an input point;

the control terminal of the driving element is coupled to the other end of the voltage storage element in parallel, which forms a coupling point; and the second electrode is coupled to the coupling point in parallel, which forms an output point;

the data input unit comprises a data signal input and a first switch by which the data signal input is coupled to the input point;

further comprising a third switch by which the driving power input is connected to the input point;

further comprising a fourth switch connected between the input point and the first electrode of the driving element;

the light-emitting working unit is coupled to the output point;

the light-emitting working unit comprises an OLED and a plate capacitor connected to the OLED in parallel;

the first switch comprises a control terminal; and the control terminal of the first switch is coupled to the control terminal of the driving element by a second plate capacitor.

2. The pixel driving circuit as claimed in claim 1, wherein the first switch, the second switch and the fifth switch are of P-type; and the first switch, the second switch and the fifth switch are controlled by a first level.

3. The pixel driving circuit as claimed in claim 2, wherein the third switch and the fourth switch are of P-type; and the third switch and the fourth switch are controlled by a second level.

4. A display panel having a pixel driving circuit, comprising:

a voltage storage element for storing a data voltage and an initial voltage, and also converting the data voltage and initial voltage into a compensation voltage;

a data input unit for controllably inputting the data voltage to the voltage storage element;

an initial voltage input for controllably inputting the initial voltage to the voltage storage element;

a driving power input for controllably supplying power to the light-emitting working unit;

a driving element for driving the light-emitting working unit;

wherein, the current supplied by the driving power input is controlled by the driving element which is responsive to magnitude of the compensation voltage discharged by the voltage storage element;

the driving element comprises a first electrode, a second electrode and a control terminal;

the first electrode is coupled to one end of the voltage storage element in parallel, which forms an input point;

the control terminal of the driving element is coupled to the other end of the voltage storage element in parallel, which forms a coupling point; and the second electrode is coupled to the coupling point in parallel, which forms an output point;

the data input unit comprises a data signal input and a first switch by which the data signal input is coupled to the input point;

further comprising a second switch connected between the coupling point and the output point;

further comprising a third switch by which the driving power input is connected to the input point;

further comprising a fourth switch connected between the input point and the first electrode of the driving element; and further comprising a fifth switch by which the initial voltage input is coupled to the input point;

the light-emitting working unit is coupled to the output point; and the light-emitting working unit comprises an OLED and a plate capacitor connected to the OLED in parallel;

the first switch comprises a control terminal; and the control terminal of the first switch is coupled to the control terminal of the driving element by a second plate capacitor.

* * * * *